US010576483B2

(12) United States Patent
Yamada

(10) Patent No.: US 10,576,483 B2
(45) Date of Patent: Mar. 3, 2020

(54) ELECTROSTATIC COATING MACHINE

(71) Applicant: ABB SCHWEIZ AG, Baden (CH)

(72) Inventor: Yukio Yamada, Fujieda (JP)

(73) Assignee: ABB SCHWEIZ AG, Baden (CH)

( * ) Notice: Subject to any disclaimer, the term of this patent is extended or adjusted under 35 U.S.C. 154(b) by 8 days.

(21) Appl. No.: 15/750,343

(22) PCT Filed: Feb. 15, 2017

(86) PCT No.: PCT/JP2017/005518
§ 371 (c)(1),
(2) Date: Feb. 5, 2018

(87) PCT Pub. No.: WO2017/141963
PCT Pub. Date: Aug. 24, 2017

(65) Prior Publication Data

US 2018/0221896 A1 Aug. 9, 2018

(30) Foreign Application Priority Data

Feb. 19, 2016 (JP) ..... 2016-029862

(51) Int. Cl.
*B05B 5/04* (2006.01)
*B05B 5/053* (2006.01)

(52) U.S. Cl.
CPC ..... *B05B 5/0426* (2013.01); *B05B 5/0407* (2013.01); *B05B 5/0533* (2013.01)

(58) Field of Classification Search
None
See application file for complete search history.

(56) References Cited

U.S. PATENT DOCUMENTS 3,635,401 A * 1/1972 Bromley ..... B05B 5/03 239/705
4,761,299 A * 8/1988 Hufstetler ..... B05B 5/03 118/629

(Continued)

FOREIGN PATENT DOCUMENTS

CN 104349843 A 2/2015
DE 10 2012 021 218 A1 4/2014
JP 8-332418 A 12/1996

OTHER PUBLICATIONS

International Search Report dated Apr. 25, 2017, in PCT/JP2017/005518 filed Feb. 15, 2017.

(Continued)

*Primary Examiner* — Jethro M. Pence
(74) *Attorney, Agent, or Firm* — Oblon, McClelland, Maier & Neustadt, L.L.P.

(57) ABSTRACT

A shaping air spurting member (9) is formed in a tubular shape by using a conductive material, and is arranged on an outer peripheral side of a rotary atomizing head (4) in a state where a front end thereof is positioned in an intermediate section of the rotary atomizing head (4) in a length direction. The shaping air spurting member (9) has a front surface section (9D) that is provided with many numbers of air spurting holes (10, 12) for spurting shaping air toward paint particles sprayed from the rotary atomizing head (4). In addition, a shield member (14) composed of an annular body extending radially is provided on an outer diameter side of the front surface section (9D) in the shaping air spurting member (9) to shield electric flux lines traveling toward the rotary atomizing head (4) from each of electrodes (6C) in an external electrode member (6).

8 Claims, 11 Drawing Sheets

(56) References Cited

U.S. PATENT DOCUMENTS

| | | | | |
|---|---|---|---|---|
| 5,676,756 | A * | 10/1997 | Murate | B05B 3/1057 118/302 |
| 2004/0255849 | A1 | 12/2004 | Giuliano et al. | |
| 2015/0128857 | A1 | 5/2015 | Yamada et al. | |

OTHER PUBLICATIONS

Combined Office Action and Search Report dated Sep. 19, 2019 in Chinese Patent Application No. 201780003521.4, with English-language translation, 15 pages.
Search Report dated Sep. 2, 2019 in European Patent Application No. 17753219.9, 7 pages.

* cited by examiner

ELECTROSTATIC COATING MACHINE

TECHNICAL FIELD

The present invention relates to an electrostatic coating machine that is configured to apply a high voltage to sprayed paint for coating.

BACKGROUND ART

In general, there is known an electrostatic coating machine of a rotary atomizing head type as an electrostatic coating machine. The electrostatic coating machine includes an air motor having an electric potential which is maintained at a ground level and that rotates a rotational shaft with compressed air supplied thereto, a rotary atomizing head that is provided on the front side of the rotational shaft and is composed of a tubular body having an electric potential which is maintained at the ground level to spray paint, which is supplied while being rotated by the air motor, from a releasing edge in a front end, an external electrode member that is positioned in back of the rotary atomizing head to be provided on an outer peripheral side of the air motor and electrifies paint particles sprayed from the releasing edge in the rotary atomizing head to be in a negative potential by applying a negative high voltage to a plural numbers of electrodes, and a shaping air spurting member that is formed in a tubular shape by using a conductive material and is arranged on an outer peripheral side of the rotary atomizing head in a state where a front end of the shaping air spurting member is positioned in an intermediate section of the rotary atomizing head in a length direction, the front end being provided with many numbers of air spurting holes over an entire circumference of the shaping air spurting member in a circumferential direction to spurt shaping air toward paint particles sprayed from the rotary atomizing head (Patent Document 1).

In a case of performing the coating by using the electrostatic coating machine as configured above, the rotary atomizing head is rotated at high speeds by the air motor, and in this state, paint is supplied to the rotary atomizing head. Therefore, the paint supplied to the rotary atomizing head is atomized by centrifugal forces generated when the rotary atomizing head rotates and is sprayed as paint particles from the releasing edge. At this time, the shaping air spurting member sprays the shaping air spurted from each of the air spurting holes to the paint particles. As a result, the shaping air controls a kinetic vector component of the paint particle in a coating object direction to adjust a spray pattern of the paint particles to a desired shape.

Further, the external electrode member, by applying a negative high voltage to each of the electrodes, electrifies the paint particles sprayed from the releasing edge of the rotary atomizing head to be in the negative polarity. Thereby, the paint particles sprayed from the rotary atomizing head are indirectly electrified to be in the negative polarity. Accordingly, the electrostatic coating machine can fly the electrified paint particles along an electrostatic field formed between each of the electrodes and the coating object to cause the coating object to be coated with the paint particles.

PRIOR ART DOCUMENT

Patent Document

Patent Document 1: Japanese Patent Laid-Open No. Hei 8-332418 A

SUMMARY OF THE INVENTION

Here, by spraying shaping air onto paint particles flying in the radical outward from the rotary atomizing head by centrifugal forces, from each of the air spurting holes in the shaping air spurting member, the electrostatic coating machine can accelerate the paint particles while gradually orienting a direction of the paint particles to the coating object. In addition, when the external electrode member electrifies the sprayed paint particles to be in the negative polarity by each of the electrodes, the paint particles are caused to fly along an electrostatic field formed between the coating object having an electric potential which is maintained at the ground level and the external electrode member to enhance a coating efficiency.

However, immediately after the paint (paint liquid thread) is separated from the releasing edge of the rotary atomizing head to become paint particles, the shaping air has a little impulse on the paint particles. Therefore, an axial kinetic vector component toward the coating object is small, and a primary kinetic vector component is a radially outward kinetic vector component. The axial kinetic vector component can be acquired by an action of the shaping air. However, a pressure of the air is not uniform because of the air being spurted from the limited number of holes arranged in a circular pattern, and the atomized paint particles vary in diameter dimension and in mass. Therefore, since the particles differ in air resistance and in inertia, the axial kinetic vector component cannot be constant.

When the paint particles are electrified to be in the negative polarity by corona discharge, a coulomb force, with which the paint particle is likely to be adsorbed to the shaping air spurting member and the rotary atomizing head having the same ground potential as that of the coating object, acts on the paint particles. On the other hand, the shaping air is caused to act on the paint particles. However, when the axial kinetic vector component cannot be acquired enough for counteracting the coulomb force by the shaping air, the paint particles return back to the coating machine direction. As a result, the returned paint particles adhere to the coating machine.

Accordingly, in the electrostatic coating machine disclosed in Patent Document 1, since a washing work is required quite frequently for preventing electrical shortcut due to the adhered paint particles, the productivity is worsened. Particularly, in a case of performing the coating in a narrow place as the vehicle compartment, there is a problem that the paint is more likely to adhere.

The present invention is made in view of the foregoing problems in the conventional art, and an object of the present invention is to provide an electrostatic coating machine that can suppress adhesion of paint to a rotary atomizing head and a shaping air spurting member.

With this arrangement, an electrostatic coating machine comprising: an air motor having an electric potential which is maintained at a ground level and that rotates a rotational shaft with compressed air supplied; a rotary atomizing head that is provided on the front side of said rotational shaft and is composed of a tubular body having an electric potential which is maintained at the ground level to spray paint, which is supplied while being rotated by the air motor, from a releasing edge in a front end; an external electrode member that is positioned in back of the rotary atomizing head and is provided on an outer peripheral side of the air motor to electrify paint particles sprayed from the releasing edge in the rotary atomizing head to be in a negative potential by applying a negative high voltage to a plural numbers of electrodes; and a shaping air spurting member that is formed in a tubular shape by using a conductive material and is arranged on an outer peripheral side of the rotary atomizing head in a state where a front end is positioned in an intermediate section of the rotary atomizing head in a length direction, the front end being provided with many numbers of air spurting holes over an entire circumference in a circumferential direction to spurt shaping air toward paint particles sprayed from the rotary atomizing head, characterized in that: a shield member is provided on an outer peripheral side of a front side section of the shaping air spurting member and is formed of an annular body radially extending to shield electric flux lines traveling toward the rotary atomizing head from each of the electrodes in the external electrode member.

According to the present invention, the adhesion of the paint onto the rotary atomizing head and the shaping air spurting member can be suppressed by flying the paint particles sprayed from the rotary atomizing head toward the coating object.

MODE FOR CARRYING OUT THE INVENTION

Hereinafter, an explanation will be in detail made of a rotary atomizing head type electrostatic coating machine of an indirect electrifying system according to embodiments of the present invention with reference to the accompanying drawings.

FIG. 1 to FIG. 4 show a first embodiment in the present invention. The first embodiment will be explained by taking a rotary atomizing head type electrostatic coating machine that is provided with a flange-shaped (disk-shaped) shield member extending in a straight line from an outer peripheral side of a front side portion of a shaping air spurting member to a radial outside, as an example. It should be noted that in the present embodiment, an arrangement relation in the later-mentioned rotary atomizing head type electrostatic coating machine 1 will be described such that a direction closer to a coating object 15 (or spurting direction of shaping air) is defined as a front side and a direction separate from the coating object 15 at the opposite to the front side is defined as a rear side.

Figure 1:
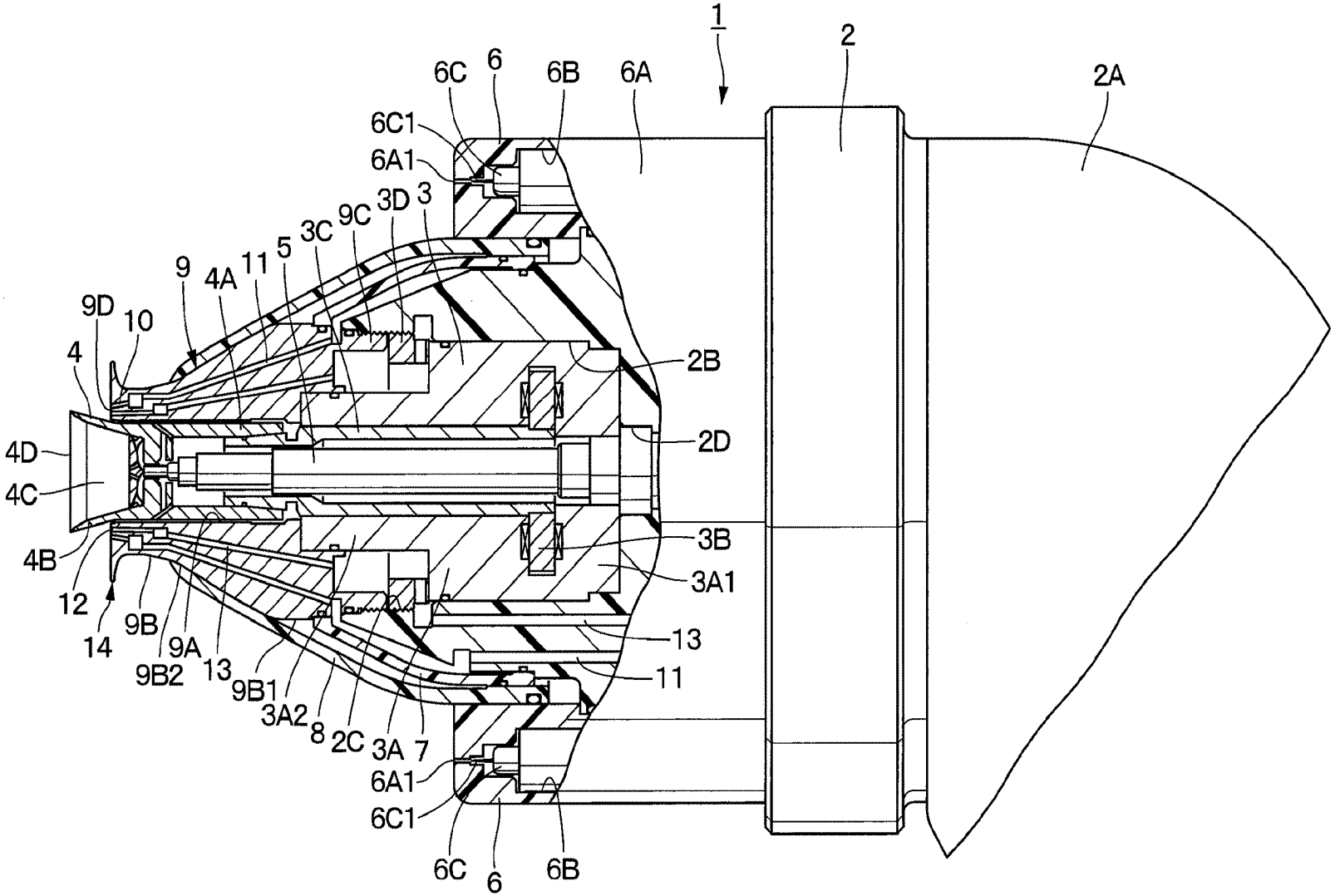
FIG. 1 is a cross sectional view showing a rotary atomizing head type electrostatic coating machine of an indirect electrifying system according to a first embodiment in the present invention.

In FIG. 1, the rotary atomizing head type electrostatic coating machine 1 (hereinafter, simply referred to as electrostatic coating machine 1) according to the first embodiment is configured as a rotary atomizing head type electrostatic coating machine of an indirect electrifying system that indirectly electrifies paint sprayed from a rotary atomizing head 4 by a later-mentioned external electrode member 6 to be at a high voltage. The electrostatic coating machine 1 is attached to a front end of an arm (not shown) in a coating robot, for example.

A coating machine support body 2 surrounds an air motor 3 as described later on an outer peripheral side of the air motor 3, and is provided to extend backward of the air motor 3. The coating machine support body 2 is mounted on a front end of the above-mentioned arm through a mounting tubular part 2A in a base end side. Here, the coating machine support body 2 is made of an insulating plastic material having rigidity, for example.

A motor accommodating part 2B is provided on a front end side of the coating machine support body 2 to open forward. A female screw part 2C is provided on an open side of the motor accommodating part 2B. Further, the coating machine support body 2 is provided with an insertion hole 2D in a central position (coaxially with an later-mentioned rotational shaft 3C) of a bottom portion in the motor accommodating part 2B to insert a base end side of an later-mentioned feed tube 5.

The air motor 3 is provided in the motor accommodating part 2B in the coating machine support body 2. The air motor 3 rotates the rotational shaft 3C and the rotary atomizing head 4 described later at high speeds, for example, 3000 rpm to 150000 rpm using compressed air as a power source. The air motor 3 is made of a conductive metallic material containing an aluminum alloy, for example, and an electric potential thereof is maintained at the ground level.

The air motor 3 includes a motor case 3A in a stepped cylindrical shape that is mounted on a front side of the coating machine support body 2, a turbine 3B, for example, in an impeller type to be positioned closer to a rear side of the motor case 3A and be rotatably accommodated, and the rotational shaft 3C that is rotatably provided in a center position of the motor case 3A and a rear end side of which is mounted to the turbine 3B.

The motor case 3A of the air motor 3 is formed as a cylindrical body arranged coaxially with the rotational shaft 3C. The motor case 3A is formed in a stepped cylindrical shape with a large diameter cylinder 3A1 that is inserted in the motor accommodating part 2B of the coating machine support body 2, and a small diameter cylinder 3A2 that projects forward from the large diameter cylinder 3A1.

The motor case 3A is inserted and fitted in the motor accommodating part 2B of the coating machine support body 2. In this state, the motor case 3A is fixed in the motor accommodating part 2B by an annular screw member 3D that is threaded in the female screw part 2C of the coating machine support body 2.

The rotational shaft 3C is formed as a hollow, tubular body that is rotatably supported through an air bearing (not shown) in the motor case 3A. The rotational shaft 3C has a rear end side that is mounted in the center of the turbine 3B, and a front end side that projects in front from the motor case 3A. The rotary atomizing head 4 is mounted on a front end part of the rotational shaft 3C using a screw means, for example.

Figure 3:
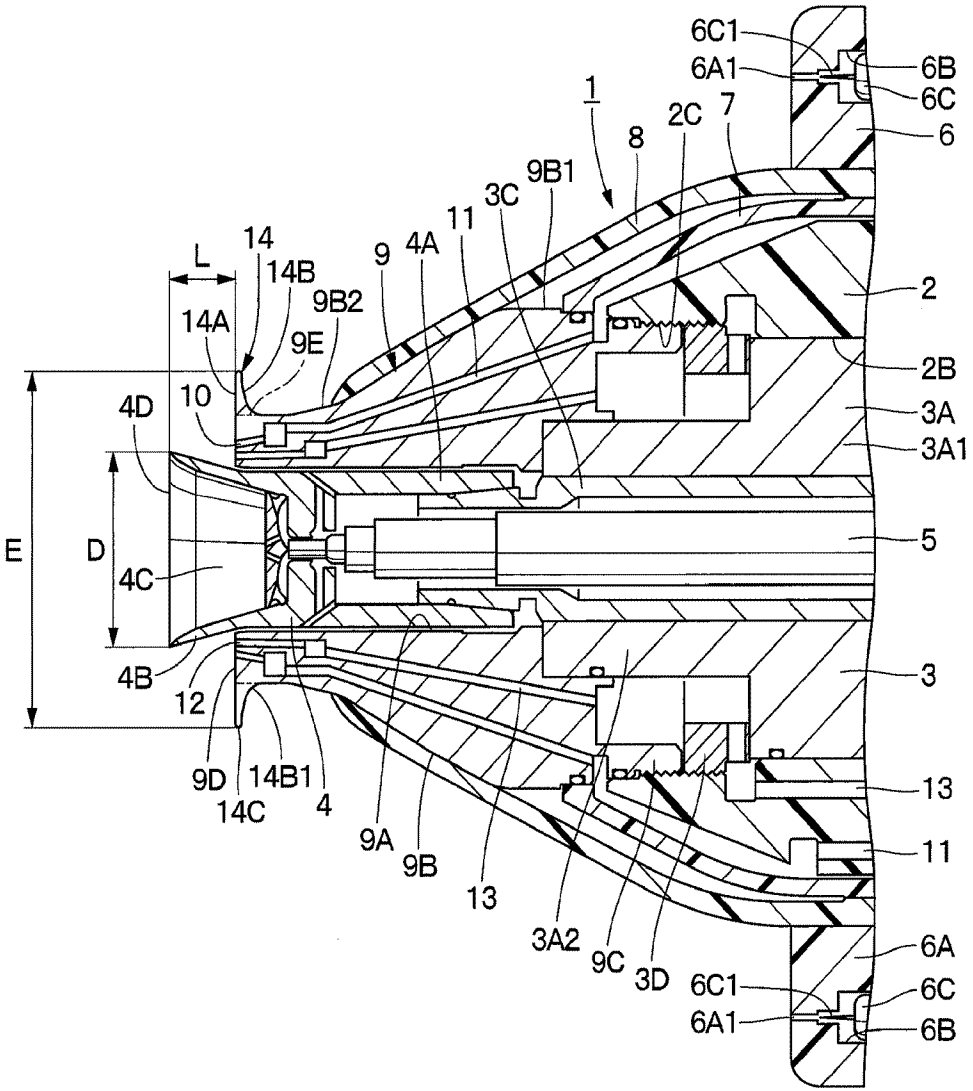
FIG. 3 is an enlarged cross section showing a front side portion of the rotary atomizing head type electrostatic coating machine.

The rotary atomizing head 4 is provided in the front side of the rotational shaft 3C in the air motor 3. The rotary atomizing head 4 is formed as a tubular body by a conductive metallic material containing an aluminum alloy, for example, and an electric potential thereof is maintained at the ground level through the air motor 3. As shown in FIG. 3, the rotary atomizing head 4 is formed as an elongated tubular body, for example, and has a rear side that is formed as an axially and linearly extending mounting section 4A. The mounting section 4A is mounted on a front end part of the rotational shaft 3C using a screw means, for example.

The front side of the rotary atomizing head 4 is formed as a flare section 4B that opens to gradually widen toward the front and an inner peripheral surface of the flare section 4B is formed as a paint spreading surface 4C for causing the supplied paint to form a film surface. Further, a tip end (front end) of the paint spreading surface 4C is formed as a releasing edge 4D that releases the film-shaped paint as paint particles. Here, the rotary atomizing head 4 is set to have a maximum diameter dimension, that is, a diameter of the releasing edge 4D is set to a dimension D (refer to FIG. 3).

In addition, the rotary atomizing head 4 is rotated at high speeds by the air motor 3. When paint is supplied to the rotary atomizing head 4 through an later-mentioned feed tube 5 in this state, the paint is sprayed from the releasing edge 4D by centrifugal forces while being formed as a thin film on the paint spreading surface 4C. In this case, the paint particles sprayed from the releasing edge 4D do not travel toward the later-mentioned coating object 15 arranged in front and are likely to fly toward a radial outward (radiate outward) by centrifugal forces of the rotary atomizing head 4.

However, the paint particles sprayed from the releasing edge 4D are accelerated to gradually travel toward the coating object 15 in front side with shaping air sprayed by a later-mentioned shaping air spurting member 9 from the rear side. Further, the paint particles sprayed from the releasing edge 4D are electrified to be in a negative polarity by an later-mentioned external electrode member 6, thereby making it possible to fly along an electrostatic field formed between the releasing edge 4D and the coating object 15 having an electric potential which is maintained at the ground level.

The feed tube 5 is provided to be inserted in the rotational shaft 3C, and a rear end side thereof is inserted and fitted in the insertion hole 2D of the coating machine support body 2. On the other hand, a front end side of the feed tube 5 projects from the rotational shaft 3C and extends into the rotary atomizing head 4. A paint passage is formed in the inside of the feed tube 5, and the paint passage is connected to a paint supply source and a washing fluid supply source (none of them is shown) through a color changing valve apparatus. Accordingly, at coating, the paint supplied through the paint passage from the paint supply source is ejected to the rotary atomizing head 4 from the feed tube 5. On the other hand, at the washing, the color changing and the like of the rotary atomizing head 4, washing fluid (thinner, air or the like) supplied from the washing fluid supply source is ejected from the feed tube 5.

The external electrode member 6 is positioned closer to the rear side than the rotary atomizing head 4 and is provided on an outer peripheral side of the air motor 3, that is, on an outer peripheral side of the coating machine support body 2. The external electrode member 6, by applying a negative high voltage to a plural numbers of electrodes 6C as described later, electrifies the paint particulates sprayed from the releasing edge 4D of the rotary atomizing head 4 to be in the negative potential.

The external electrode member 6 includes an annular external electrode support tubular body 6A that is made of an insulating plastic material and is provided on an outer peripheral side of the coating machine support body 2, a plural numbers (8 to 20 numbers, for example) of electrode mounting holes 6B (only two numbers are shown) that are arranged on the external electrode support tubular body 6A in a circumferential direction by equal intervals, and electrodes 6C that are mounted on the respective electrode mounting holes 6B. Holes 6A1 in number corresponding to needle parts 6C1 of the respective electrodes 6C are provided in the front side of the external electrode support tubular body 6A.

Here, the external electrode member 6 according to the first embodiment is provided in a position closer to the rear side of the coating machine support body 2 and near the outer peripheral side of the coating machine support body 2 for using the electrostatic coating machine 1 in a narrow space as in the inside of a vehicle body. As a result of this arrangement, the needle part 6C1 of each of the electrodes 6C is arranged in a position largely separated from the rotary atomizing head 4 in an axial rear side, that is, on an outer peripheral side of the air motor 3. Further, the needle part 6C1 of each of the electrodes 6C is arranged in a position near an axial outside of an outer cover member 8 as described later. Accordingly, at a coating work time, each of the electrodes 6C can be suppressed from interfering with circumferential members.

The respective electrodes 6C are connected to a high-voltage generator through resistances (none of them is shown). Accordingly, a negative high voltage is applied to each of the electrodes 6C by the high voltage generator. Therefore, the external electrode member 6 electrifies paint particles sprayed from the rotary atomizing head 4 to be in the negative polarity due to generation of corona discharge in each of the electrodes 6C.

An inner cover member 7 forms a cover member together with an outer cover member 8 as described later, and is formed as a tubular body that is reduced in diameter in an arc shape toward the front side, made of an insulating plastic material, for example. The inner cover member 7 is provided between the external electrode member 6 and a shaping air spurting member 9 as described later in such a manner as to surround the air motor 3. The inner cover member 7 has the rear side that is mounted to an outer peripheral side of the coating machine support body 2 and the front side that is mounted to a rear side section of an outer peripheral surface 9B of the shaping air spurting member 9.

The outer cover member 8 forms the cover member together with the inner cover member 7, and in the same way as the inner cover member 7, is formed as a tubular body that is reduced in diameter in an arc shape toward the front side, made of an insulating plastic material. The outer cover member 8 is provided between the external electrode member 6 and the shaping air spurting member 9 in such a manner as to surround the air motor 3 in a position further outside of the inner cover member 7.

The outer cover member 8 has the rear side that is mounted between the inner cover member 7 and an inner peripheral side of the external electrode member 6 and the front side that is mounted to a front side section of the outer peripheral surface 9B of the shaping air spurting member 9. The outer cover member 8 can be removed at the assembly work or the disassembly work of the rotary atomizing head 4 and the shaping air spurting member 9.

The shaping air spurting member 9 is arranged on the outer peripheral side of the rotary atomizing head 4 in a state where the front end (front surface section 9D as described later) of the shaping air spurting member 9 is positioned in an intermediate section (in back of the flare section 4B) of the rotary atomizing head 4 in the length direction. The shaping air spurting member 9 is formed of a conductive metallic material containing an aluminum alloy, for example, and an electric potential thereof is maintained at the ground level through the air motor 3.

The shaping air spurting member 9 is formed as a stepped cylindrical body that surrounds the rotary atomizing head 4. An inner peripheral surface 9A of the shaping air spurting member 9 faces the outer peripheral surface of the rotary atomizing head 4 to have a slight clearance therebetween. On the other hand, the outer peripheral surface 9B of the shaping air spurting member 9 has the rear side that is formed as an inner cover mounting section 9B1 and the front side that is formed as a tapered section 9B2 gradually reducing in diameter toward the front side.

A front side section of the inner cover member 7 is mounted on the inner cover mounting section 9B1 in a state of being fitted thereupon. The tapered section 9B2 is covered with the outer cover member 8 to a position close to the front side of an intermediate part, and the front side ahead of it is exposed to an exterior. In addition, the tapered section 9B2 is smoothly formed with an arc surface in such a manner as to prevent an electrical filed by the external electrode member 6 from focusing on a part of the tapered section 9B2.

A rear end section of the shaping air spurting member 9 is formed as a cylindrical mounting screw part 9C, and the mounting screw part 9C is threaded into the female screw part 2C of the coating machine support body 2. Thereby, the shaping air spurting member 9 is mounted on the front side section of the coating machine support body 2 using the mounting screw part 9C.

Here, descriptions will be in detail made of a basic form of the front side section of the shaping air spurting member 9. In this case, the front side section of the shaping air spurting member 9 has a virtual boundary surface 9E in a range extending cylindrically toward the front from the front part of the tapered section 9B2, that is, in a cylindrical shape shown in a two-dot chain line in FIG. 2 and FIG. 3. In regard to the virtual boundary surface 9E of the shaping air spurting member 9, a shape similar thereto is described as a comparative example in FIG. 12. That is, the cylindrical virtual boundary surface 9E of the shaping air spurting member 9 corresponds to a front cylindrical surface 9E' of the tapered section 9B2 in the shaping air spurting member 9 in FIG. 12. Thereby, in a case of providing an later-mentioned shield member 14 in the front side section of the shaping air spurting member 9, the cylindrical virtual boundary surface 9E forms a boundary part between the shaping air spurting member 9 and the shield member 14, and a part closer to an outer diameter side than the virtual boundary surface 9E becomes the shield member 14.

Figure 2:
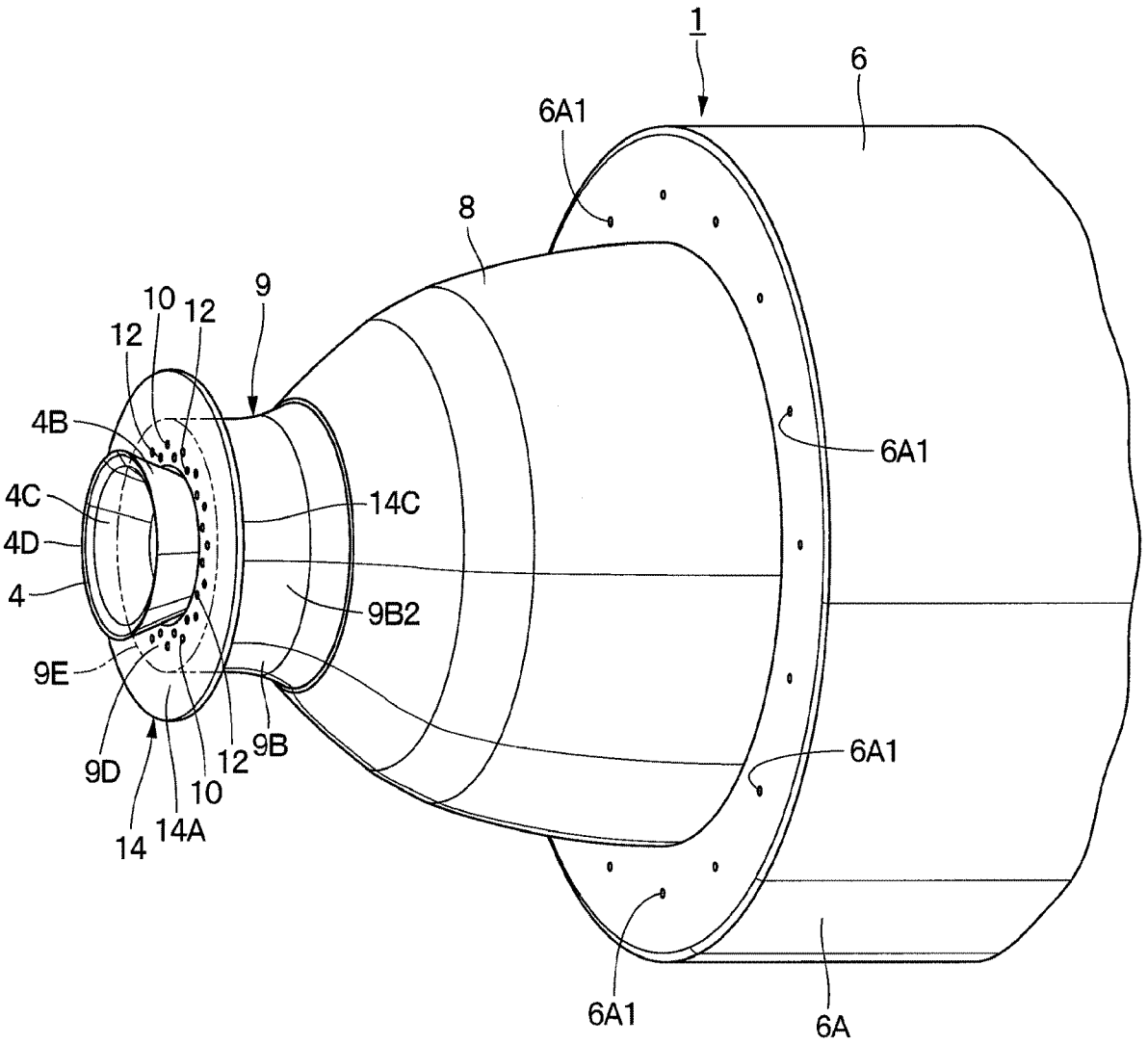
FIG. 2 is a perspective view showing the rotary atomizing head type electrostatic coating machine of the indirect electrifying system.

Further, as shown in FIG. 2 and FIG. 3, the front end (front side section) of the shaping air spurting member 9 is formed as the flat annular front surface section 9D. The front surface section 9D is provided with first air spurting holes 10 and second air spurting holes 12 that open to an exterior. The front surface section 9D is arranged around a rear part position of the flare section 4B in the rotary atomizing head 4.

The first air spurting holes 10 comprise many numbers of the holes that are positioned closer to an outer diameter side of the front surface section 9D to be arranged over an entire circumference in a circumferential direction by equal intervals. The first air spurting holes 10 are connected to a first shaping air supply source (not shown) through first shaping air passages 11. The first air spurting holes 10 spurt first shaping air toward the vicinity of the releasing edge 4D in the rotary atomizing head 4.

The second air spurting holes 12 comprise many numbers of the holes that are positioned closer to a radial inside than the first air spurting holes 10 to be arranged in the front surface section 9D over an entire circumference in a circumferential direction by equal intervals. The second air spurting holes 12 are connected to a second shaping air supply source (not shown) through second shaping air passages 13. The second air spurting holes 12 spurt second shaping air toward the backside in the rotary atomizing head 4.

As a result, the first shaping air spurted from the first air spurting holes 10 and the second shaping air spurted from the second air spurting holes 12 shear liquid threads of paint released from the releasing edge 4D of the rotary atomizing head 4 to speed up formation of paint particles and adjust the shape of a spray pattern of paint particles sprayed from the rotary atomizing head 4. At this time, a pressure of the first shaping air and a pressure of the second shaping air are adjusted as needed, thus making it possible to change the spray pattern to a desired size and shape. Further, the first and second shaping air are sprayed on the paint particles flying toward the radial outside from the releasing edge 4D of the rotary atomizing head 4 by centrifugal forces to accelerate the paint particles while causing the paint particles to be gradually oriented to a coating object.

Next, an explanation will be in detail made of the configuration of the shield member 14 that is a characteristic part in the first embodiment.

The shield member 14 is positioned in the outer diameter side of the front surface section 9D in the shaping air spurting member 9 and is formed as the annular body extending radially. The shield member 14 shields electric flux lines traveling toward the rotary atomizing head 4 from the respective electrodes 6C in the external electrode member 6. The shield member 14 is formed as the annular member that extends in the radial outward, for example, a flange-shaped plate body on a basis of the virtual boundary surface 9E positioned in the outer diameter side of the front surface section 9D in the shaping air spurting member 9, that is, in the front side of the tapered section 9B2 of the outer peripheral surface 9B.

The shield member 14 is formed to be integral with the shaping air spurting member 9 outward of the virtual boundary surface 9E on a basis thereof. Thereby, an electric potential of the shield member 14 is maintained at the ground level through the shaping air spurting member 9 or the like.

The shield member 14 includes a front surface part 14A that is flush with the front surface section 9D in the shaping air spurting member 9, a rear surface part 14B that is positioned at the opposite to the front surface part 14A in a front-rear direction, and a peripheral edge part 14C that is an outermost peripheral part of the front surface part 14A and the rear surface part 14B. A connecting section of the rear surface part 14B to the tapered section 9B2 of the outer peripheral surface 9B is formed as a smooth arc-shaped surface 14B1. The arc-shaped surface 14B1 can enhance washing performance of the adhered paint due to eliminating angled corners.

Here, an explanation will be made of a size and an arrangement position of the shield member 14. First, a diameter dimension E of the shield member 14 is set according to the following formula 1 in relation to a diameter dimension D of the releasing edge 4D of the rotary atomizing head 4.

$$1.4D \leq E \leq 3.0D,$$

Preferably, $$1.5D \leq E \leq 2.5D \quad \text{[Formula 1]}$$

Accordingly, after the paint particles are sufficiently accelerated toward the coating object 15 by the shaping air spurted from the shaping air spurting member 9, the shield member 14 can adjust electric flux lines by each of the electrodes 6C of the external electrode member 6 in such a manner that the paint particles are electrified to have a high voltage.

Further, an axial installation position of the shield member 14, that is, a backward distance dimension L from the releasing edge 4D of the rotary atomizing head 4 to the front surface part 14A of the shield member 14 is set according to the following formula 2.

$$1\ \text{mm} \leq L \leq 50\ \text{mm} \quad \text{[Formula 2]}$$

In this case, by arranging the shield member 14 in a position near the releasing edge 4D of the rotary atomizing head 4, that is, by making the distance dimension L small, the diameter dimension E of the shield member 14 can be suppressed to be small. Thereby, since the shield member 14 can be formed in a compact manner, the coating can be performed without interfering with surrounding members even in a narrow place as the inside of the vehicle body. Therefore, it is desirable that the distance dimension L between the rotary atomizing head 4 and the shield member 14 is set to be small.

On the other hand, the washing performance of the paint adhered to the shield member 14 can be enhanced by making a difference in level between the front surface part 14A and the front surface section 9D of the shaping air spurting member 9 small (or eliminating the difference). Further, the shield member 14 is formed, for example, in a position of shielding a straight line that connects the needle part 6C1 of each of the electrodes 6C in the external electrode member 6 and the releasing edge 4D of the rotary atomizing head 4.

Next, an explanation will be made of an operation in a case of performing the coating on the coating object 15 by the electrostatic coating machine 1.

First, a coating work by the electrostatic coating machine 101 according to the conventional technology as a comparative example will be described with reference to FIG. 12. The electrostatic coating machine 101 is configured in the same way as the electrostatic coating machine 1 according to the first embodiment except for a point where the shield member 14 is not provided.

Turbine air is supplied to the turbine 3B of the air motor 3 to rotate the rotational shaft 3C. Accordingly, the rotary atomizing head 4 together with the rotational shaft 3C rotate at high speeds. When the paint selected in the color changing valve device (not shown) is supplied to the rotary atomizing head 4 through the paint passage in the feed tube 5 in this state, the paint can be sprayed as paint particles from the releasing edge 4D by centrifugal forces while being formed as a thin film on the paint spreading surface 4C of the rotary atomizing head 4.

Figure 12:
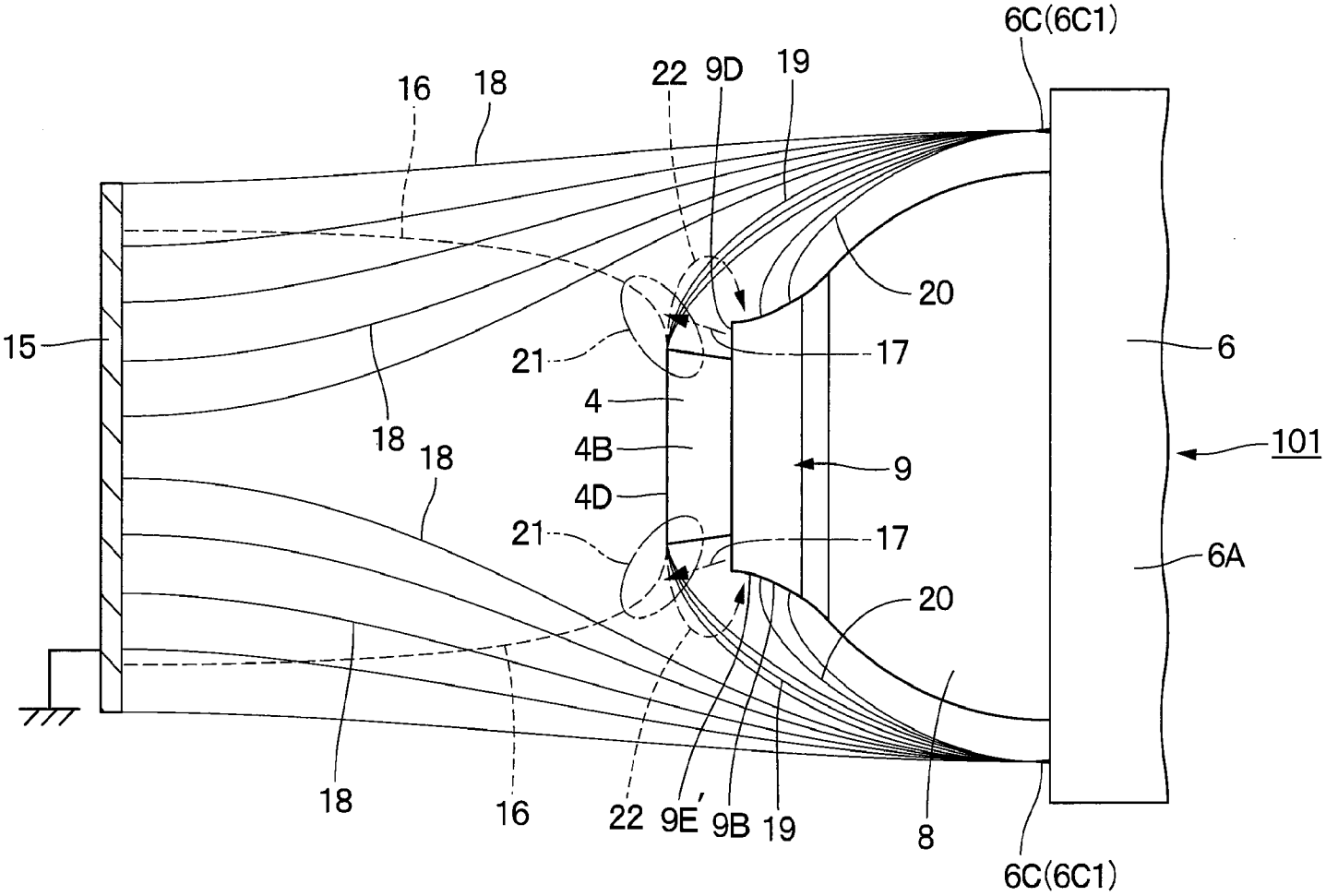
FIG. 12 is an explanatory diagram schematically showing a relation between paint particles, shaping air and electric flux lines according to a comparative example.

In this case, as shown in a dotted line 16 in FIG. 12, immediately after the paint particles are separated from the releasing edge 4D of the rotary atomizing head 4, the paint particles do not travel toward the coating object 15 arranged forward and are likely to fly toward a radial outward in a radial fashion by centrifugal forces of the rotary atomizing head 4. Therefore, as shown in an arrow 17 in a dashed-dotted chain line in FIG. 12, the shaping air spurting member 9 sprays the shaping air toward the paint particles from the respective air spurting holes 10, 12. Thereby, the shaping air causes the paint particles to be gradually oriented toward the coating object 15 by its forward driving force and to be accelerated. In addition, the shaping air can adjust the shape of the spray pattern of the paint particles while atomizing the paint particles.

When paint particles are sprayed from the releasing edge 4D of the rotary atomizing head 4, a negative high voltage by a high-voltage generator is applied to each of the electrodes 6C in the external electrode member 6. Each of the electrodes 6C form electric flux lines 18 between each of the electrodes 6C and the coating object 15 having an electric potential which is maintained at the ground level and electrifies the paint particles sprayed from the releasing edge 4D to be in the negative polarity. As a result. the paint particles are caused to travel along the electric flux lines 18, which can efficiently supply the paint particles to the coating object 15.

However, an electric potential of both the rotary atomizing head 4 and the shaping air spurting member 9 is also maintained at the ground level. Therefore, electric flux lines 19 are formed also between each of the electrodes 6C and the front end (releasing edge 4D) of the rotary atomizing head 4, and electric flux lines 20 are formed also between each of the electrodes 6C and the outer peripheral surface 9B of the shaping air spurting member 9.

Here, since the electric flux lines 19 traveling toward the rotary atomizing head 4 from each of the electrodes 6C concentrate on the releasing edge 4D of the rotary atomizing head 4, discharge (corona discharge) is generated in the releasing edge 4D as well in addition to the front end of each of the electrodes 6C. At this time, ion particles due to the discharge collide with paint particles in a front end position of the rotary atomizing head 4 to electrify the paint particles to be in the negative polarity (collision electrification). Therefore, the front end position of the rotary atomizing head 4 becomes an electrified area 21 (area surrounded in a two-dot chain line) where the paint particles are electrified to be in the negative polarity.

As a result, the paint particles, immediately after being separated from the releasing edge 4D of the rotary atomizing head 4, are electrified to be in the negative polarity. The paint particles, immediately after being separated therefrom, have weak forward driving forces by the shaping air, and have radial outward kinetic vector components. In addition, since the shaping air is spurted from many numbers of the air spurting holes 10, 12 arranged annually, it is difficult to acquire a uniform spurting pressure. Further, the atomized paint particles have variations in a diameter dimension and in weight. Therefore, the axial kinetic vector components do not become constant due to differences in air resistance and inertia of particles.

When the paint particles are electrified to be in the negative polarity in this state, particles having a particularly weak function of the shaping air out of the electrified paint particles are, as shown in a dotted line 22, pulled to the rotary atomizing head 4, the shaping air spurting member 9 and the like arranged near the external electrode member 6 by coulomb forces to adhere thereto and to contaminate them.

Figure 4:
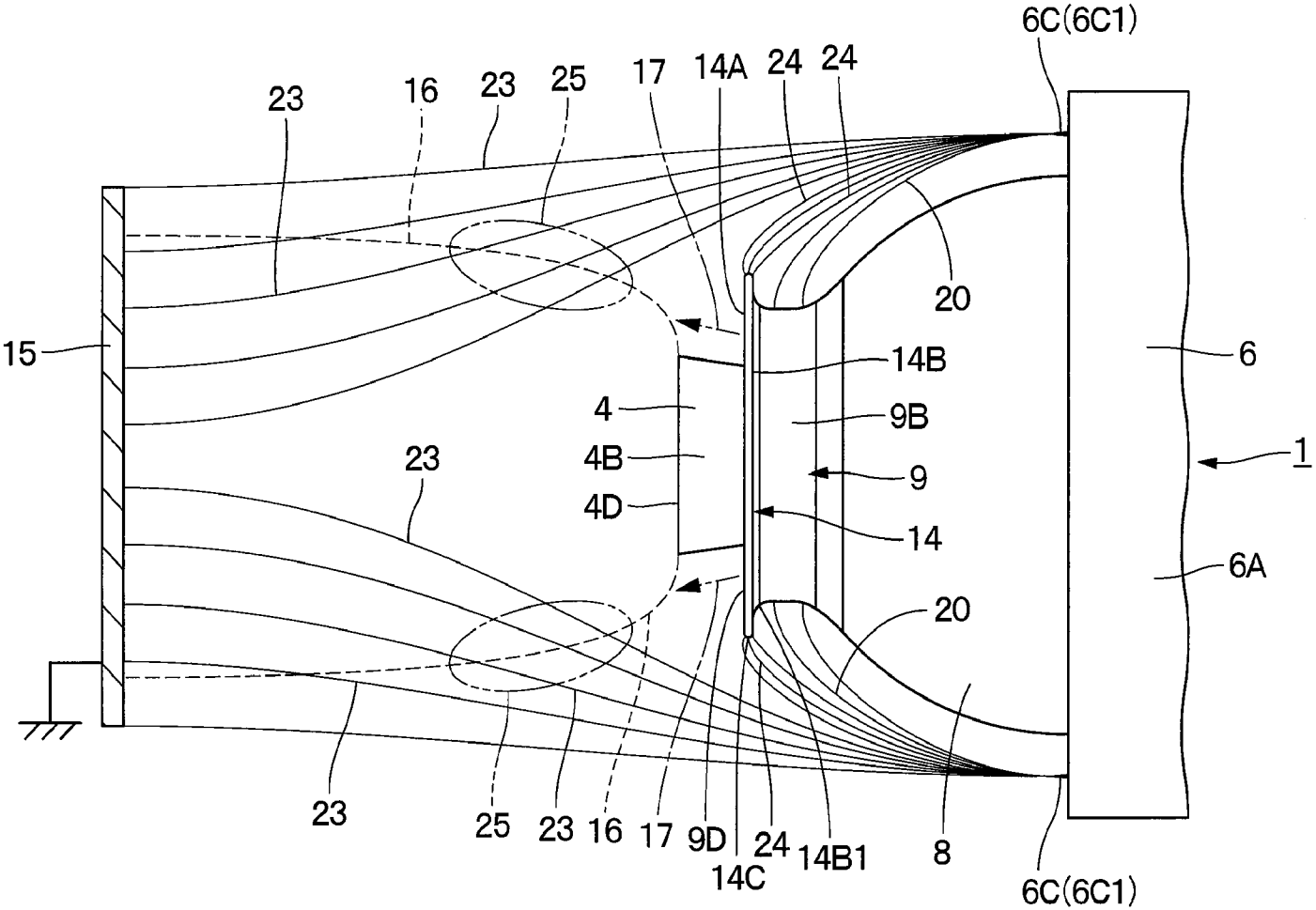
FIG. 4 is an explanatory diagram schematically showing a relation between paint particles, shaping air and electric flux lines in a case of providing a shield member.

Next, an explanation will be made of electric flux lines and a flying state of paint particles in a case of performing the coating by the electrostatic coating machine 1 provided with the shield member 14 according to the first embodiment with reference to FIG. 4.

When the paint particles are sprayed from the releasing edge 4D of the rotary atomizing head 4, each of the electrodes 6C of the external electrode member 6 forms electric flux lines 23 between each of the electrodes 6C and the coating object 15 having an electric potential which is maintained at the ground level. As a result, it is possible to efficiently supply the paint particles to the coating object along the electric flux lines 23.

In this case, an electric potential of both the rotary atomizing head 4 and the shaping air spurting member 9 is also maintained at the ground level. However, the shield member 14 having the electric potential which is maintained at the ground level is provided between the rotary atomizing head 4 and each of the electrodes 6C. Accordingly, the electric flux lines traveling toward the releasing edge 4D of the rotary atomizing head 4 from each of the electrodes 6C in the external electrode member 6 can be shielded by the shield member 14. Specifically, by forming electric flux lines 24 between each of the electrodes 6C and the peripheral edge part 14C of the shield member 14, density of electric flux lines between each of the electrodes 6C and the rotary atomizing head 4 can be made low.

Further, discharge is generated on the peripheral edge part 14C of the shield member 14 by the electric flux lines 24. At this time, the shaping air spurted from each of the air spurting holes 10, 12 flows forward of the rotary atomizing head 4 involving the surrounding air in an area in front of the peripheral edge part 14C. Therefore, ion particles generated by the discharge of the peripheral edge part 14C of the shield member 14 collide with paint particles forward of the rotary atomizing head 4 to generate collision electrification in the paint particles.

Therefore, an electrified area 25 (area surrounded in a two-dot chain line) where the paint particles sprayed from the rotary atomizing head 4 are to be electrified to be in the negative polarity can be set to a position separated outward and forward from the releasing edge 4D of the rotary atomizing head 4. Accordingly, the paint particles sprayed from the releasing edge 4D of the rotary atomizing head 4 can accelerate toward the coating object 15 by the shaping air until reaching the electrified area 25. Thereby, in a case where the paint particles are electrified to be in the negative polarity in the electrified area 25, since the paint particles do not fly to the electrostatic coating machine 1-side, it is possible to improve a coating efficiency on the coating object 15 while preventing contamination of the electrostatic coating machine 1 due to the return of the paint particles.

In this way, according to the first embodiment, the shield member 14 formed of the annular body extending to the radial outward from the virtual boundary surface 9E is provided on the outer diameter side of the front surface section 9D in the shaping air spurting member 9. As a result, the shield member 14 can shield the electric flux lines traveling toward the rotary atomizing head 4 from each of the electrodes 6C in the external electrode member 6. Thereby, since the paint particles are electrified after accelerating toward the coating object 15, it is possible to suppress the contamination of the electrostatic coating machine 1 including the shaping air spurting member 9 due to the returned paint.

As a result, since it is possible to reduce frequency of the washing work on the adhered paint by providing the shield member 14, it is possible to improve the productivity in a case of performing the coating work using the electrostatic coating machine 1.

The shield member 14 is formed as the annular plate body extending in the radial outward from the outer diameter side of the shaping air spurting member 9. Accordingly, the shield member 14 formed of the plate body can be easily provided, making it possible to prevent the contamination due to the adherence of the paint at low costs. In addition, the thin shield member 14 can concentrate the electric flux lines on the peripheral edge part 14C.

Further, since the shield member 14 is formed to be integral with the shaping air spurting member 9, the electric potential of the shield member 14 can be maintained at the ground level through the shaping air spurting member 9. Based thereupon, the event that the paint enters a mounting clearance between the shaping air spurting member 9 and the shield member 14 can be prevented in advance, therefore shortening the washing time.

The coating machine support body 2 is provided on the outer peripheral side of the air motor 3 to surround the air motor 3 and extend closer to the rearward than the air motor 3. In addition, the external electrode member 6 includes the annular external electrode support tubular body 6A that is provided on the outer peripheral side of the coating machine support body 2 and is formed of an insulating plastic material, and the plural numbers of electrodes 6C that are arranged in the circumferential direction on the front end side of the external electrode support tubular body 6A. Accordingly, the external electrode member 6 can be arranged on the outer peripheral side of the coating machine support body 2 in the insulating state. Further, since the plural numbers of electrodes 6C can be arranged in a compact manner, the external electrode member 6 can be miniaturized to provide a coating machine suitable for the coating in a narrow place.

The inner cover member 7 formed in a tubular shape in a state of surrounding the air motor 3 and the outer cover member 8 surrounding the outer side of the inner cover member 7 are provided between the external electrode member 6 and the shaping air spurting member 9. Accordingly, the air motor 3 is covered and hidden with the inner cover member 7 and the outer cover member 8. In this case, even when the paint adheres to the outer cover member 8 having an outer surface formed to be smooth and in an arc shape, the adhered paint can be securely washed for a short time.

Further, since the shield member 14 is formed in a flange shape, the electric flux lines 24 concentrate on the peripheral edge part 14C to generate discharge. The ion particles due to the discharge collide with the paint particles in front of the rotary atomizing head 4 by the air flow of the shaping air. As a result, the paint particles can be electrified in the electrified area 25 where the paint particles are sufficiently accelerated toward the coating object 15.

Figure 5:
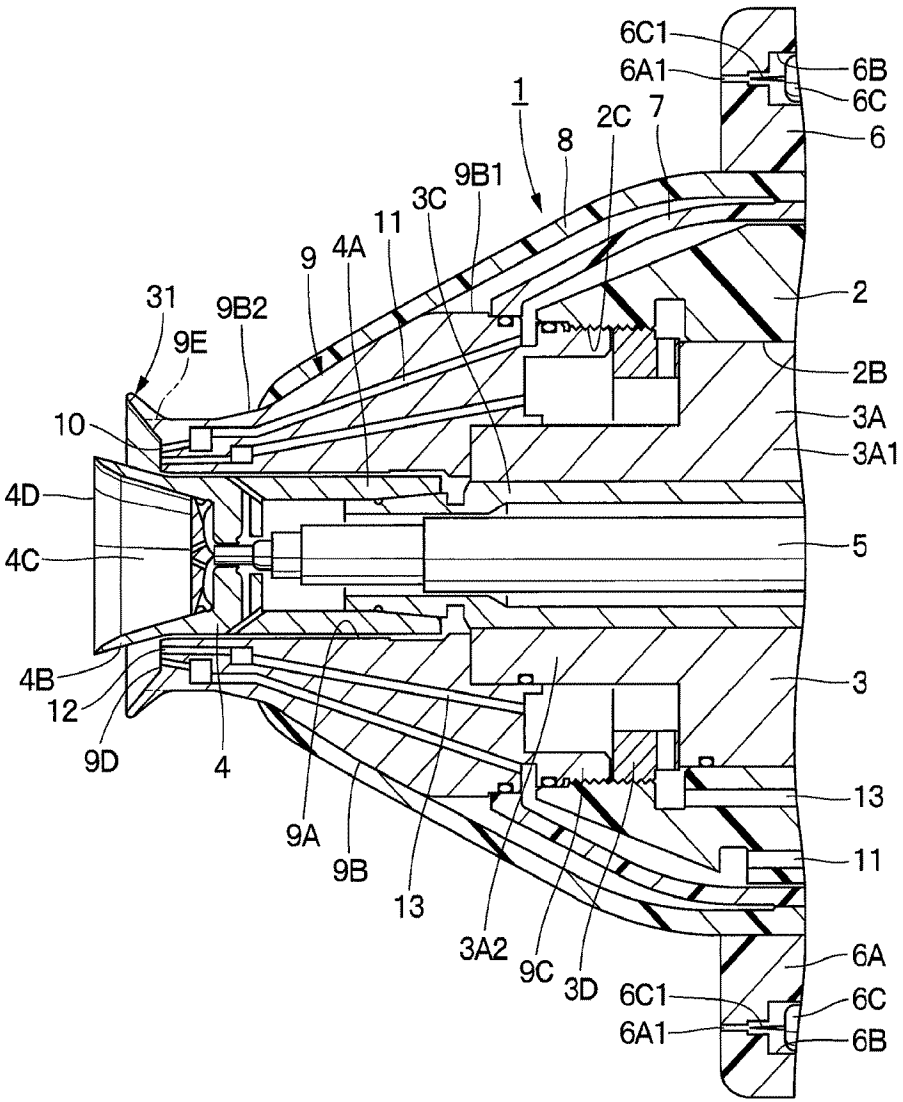
FIG. 5 is an enlarged cross sectional view showing a front side portion of a rotary atomizing head type electrostatic coating machine according to a second embodiment.

Next, FIG. 5 shows a second embodiment of the present invention. The second embodiment is characterized in that a shield member is formed as a tapered body that opens to widen toward the front side of the front side section of a shaping air spurting member from the outer diameter side of the front side section. In this second embodiment, components similar to those in the aforementioned first embodiment will be referred as the same reference numerals and its explanation is omitted.

In FIG. 5, a shield member 31 according to the second embodiment is, as substantially similar to the shield member 14 according to the first embodiment, positioned in the outer diameter side of the front surface section 9D in the shaping air spurting member 9 and is formed as an annular body extending radially. Specifically, the shield member 31 is provided closer to the outer diameter side than the virtual boundary surface 9E provided in the outer diameter side of the front side section in the shaping air spurting member 9 with the virtual boundary surface 9E being configured as a boundary to the shaping air spurting member 9.

However, the shield member 31 according to the second embodiment differs from the shield member 14 according to the first embodiment in a point of being formed as a tapered body that opens to widen toward the front.

In this way, the second embodiment as configured above can also acquire a functional effect substantially similar to that of the first embodiment as mentioned before. Particularly, according to the second embodiment, since the shield member 31 is formed as the tapered body, even when the shield member 31 is formed to be small in a diameter dimension, the shield member 31 can shield an area between each of the electrodes 6C of the external electrode member 6 and the releasing edge 4D of the rotary atomizing head 4. As a result, it is possible to improve the workability in a case of performing the coating in a narrow place or in an elaborate place. Based thereupon, the shield member 31 can reduce the electric flux lines traveling from each of the electrodes 6C of the external electrode member 6 toward the releasing edge 4D and can further suppress the discharge in the releasing edge 4D. In addition, even in a case of arranging the external electrode member 6 in front, the shield member 31 can be formed in a position of shielding a straight line connecting the needle part 6C1 of each of the electrodes 6C and the releasing edge 4D of the rotary atomizing head 4.

Figure 6:
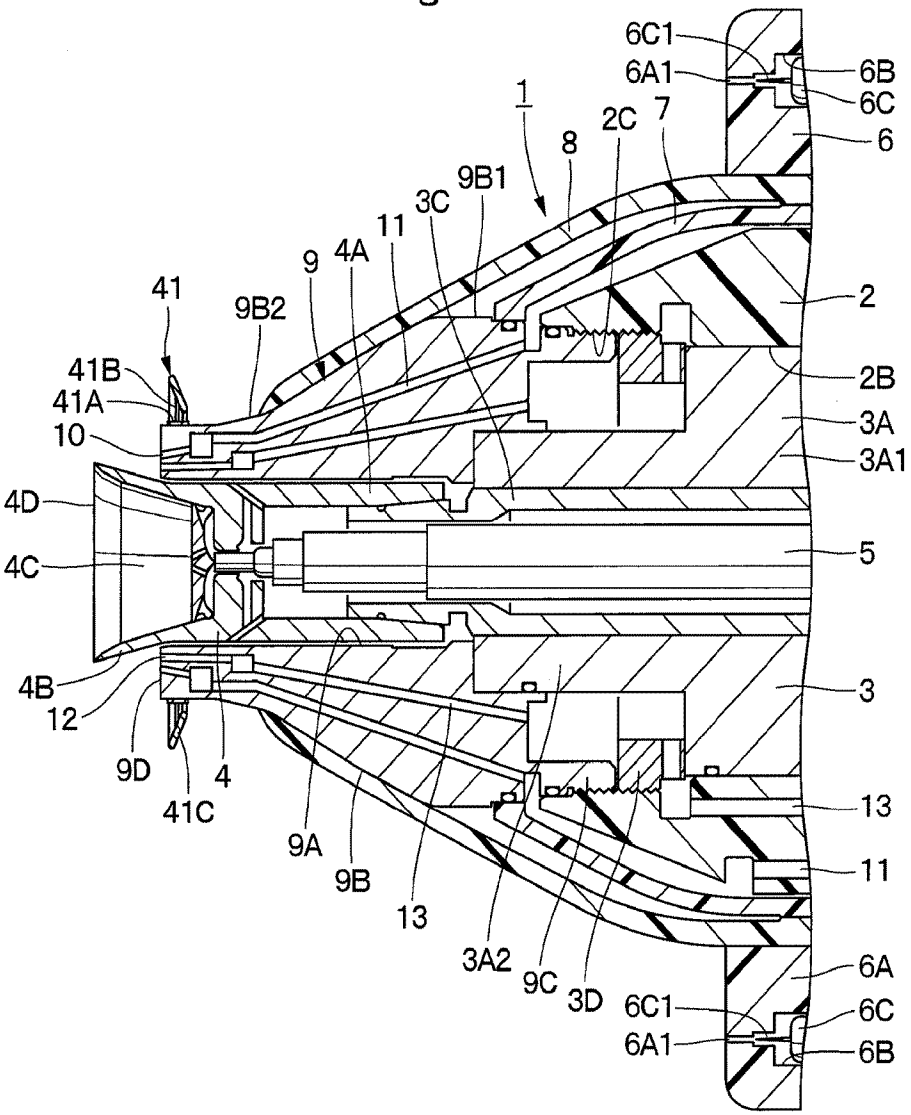
FIG. 6 is an enlarged cross sectional view showing a front side portion of a rotary atomizing head type electrostatic coating machine according to a third embodiment.

Next, FIG. 6 shows a third embodiment of the present invention. The third embodiment is characterized in that a shield member is formed of a conductive material, provided to be separated from a shaping air spurting member, and is mounted to an outer diameter side of the shaping air spurting member in an electrically connected state. In the third embodiment, components similar to those in the aforementioned first embodiment will be referred as the same reference numerals and its explanation is omitted.

In FIG. 6, the shield member 41 according to the third embodiment is provided to be separated from the shaping air spurting member 9. In addition, the shield member 41 is formed of a conductive material containing an aluminum alloy, for example, and is connected electrically to the outer diameter side of the shaping air spurting member 9.

The shield member 41 includes a cylindrical mounting ring 41A that is mounted to be fitted on the outer peripheral surface 9B of the shaping air spurting member 9, and an annular shield disk 41C that is provided on an outer peripheral side of the mounting ring 41A through a plural numbers of stays 41B. The shield disk 41C is inclined in the front side toward a radial outward to be formed in a tapered shape. In addition, the shield member 41 is arranged, for example, in a position of shielding a straight line connecting the needle part 6C1 of each of the electrodes 6C in the external electrode member 6 and the releasing edge 4D of the rotary atomizing head 4.

In this way, the third embodiment as configured above can also acquire a functional effect substantially similar to that of the aforementioned first embodiment. Particularly, according to the third embodiment, since the shield member 41 is provided to be separated from the shaping air spurting member 9, the shield member 41 can be provided to be retrofitted to the existing shaping air spurting member 9. In addition, in the shield member 41, a position, an angle and a size of the shield disk 41C can be set optionally. Therefore, even when a position of the external electrode member 6 differs in a front-rear direction or in a radial direction, the shield member 41 can be formed in a position of shielding a straight line connecting the needle part 6C1 of each of the electrodes 6C and the releasing edge 4D of the rotary atomizing head 4, enhancing freedom degrees at designing, general-purpose properties and the like.

Figure 7:
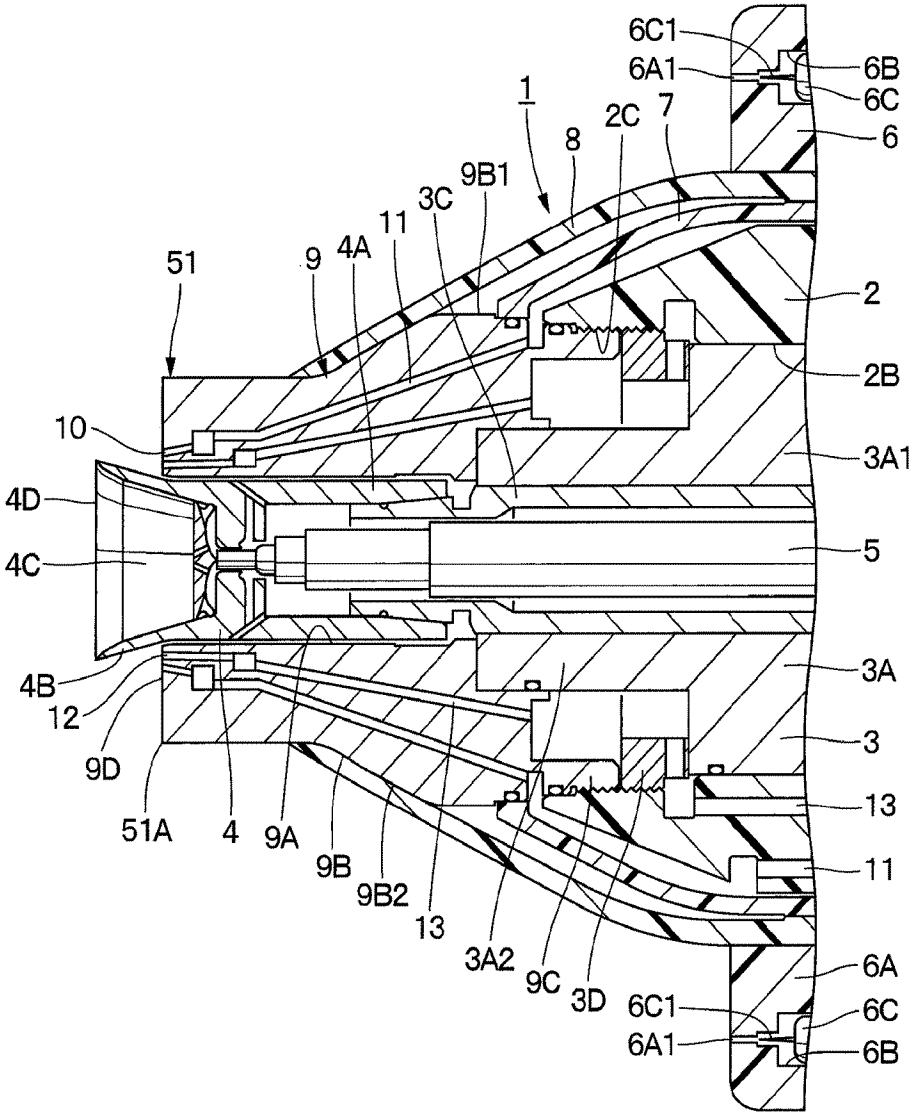
FIG. 7 is an enlarged cross sectional view showing a front side portion of a rotary atomizing head type electrostatic coating machine according to a fourth embodiment.

Next, FIG. 7 shows a fourth embodiment of the present invention. The fourth embodiment is characterized in that a shield member is provided to be integral with an outer peripheral surface of a shaping air spurting member. In the fourth embodiment, components similar to those in the aforementioned first embodiment will be referred as the same reference numerals and its explanation is omitted.

In FIG. 7, a shield member 51 according to the fourth embodiment is provided to be integral with the shaping air spurting member 9 by forming an outer peripheral side of the shaping air spurting member 9 to be thicker. The shield member 51 is formed to be thicker to a position of shielding a straight line connecting the needle part 6C1 of each of the electrodes 6C in the external electrode member 6 and the releasing edge 4D of the rotary atomizing head 4, for example. In addition, an outer peripheral section of a front end of the shield member 51 is formed as a substantially right-angled corner part 51A. As similar to the peripheral edge part 14C of the shield member 14 according to the first embodiment, electric flux lines concentrate on the corner part 51A, making it possible to generate discharge.

In this way, the fourth embodiment as configured above can also acquire a functional effect substantially similar to that of the aforementioned first embodiment. Particularly, according to the fourth embodiment, irregularity of the shield member 51 can be made small, improving the washing performance.

Figure 8:
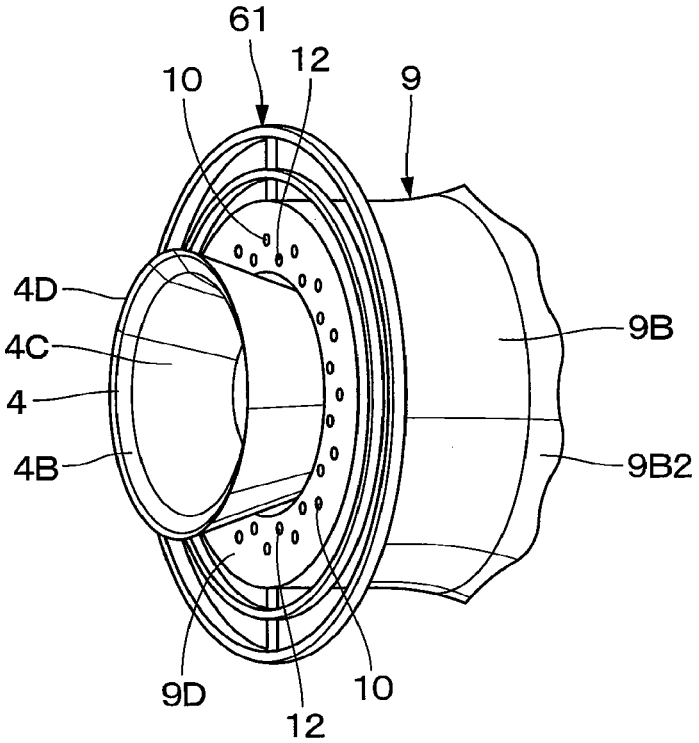
FIG. 8 is an enlarged perspective view showing an essential part of a shield member with a shaping air spurting member and a rotary atomizing head according to a first modification.

It should be noted that the first embodiment is explained by taking a case where the shield member 14 is formed of the annular plate body (flange-shaped body), as an example. However, the present invention is not limited thereto, but a shield member, for example, may be formed as a first modification shown in FIG. 8. That is, a shield member 61 according to the first modification is configured to arrange a piece or a plural numbers of wire processed to form a circular shape, which are connected electrically to the shaping air spurting member 9.

Figure 9:
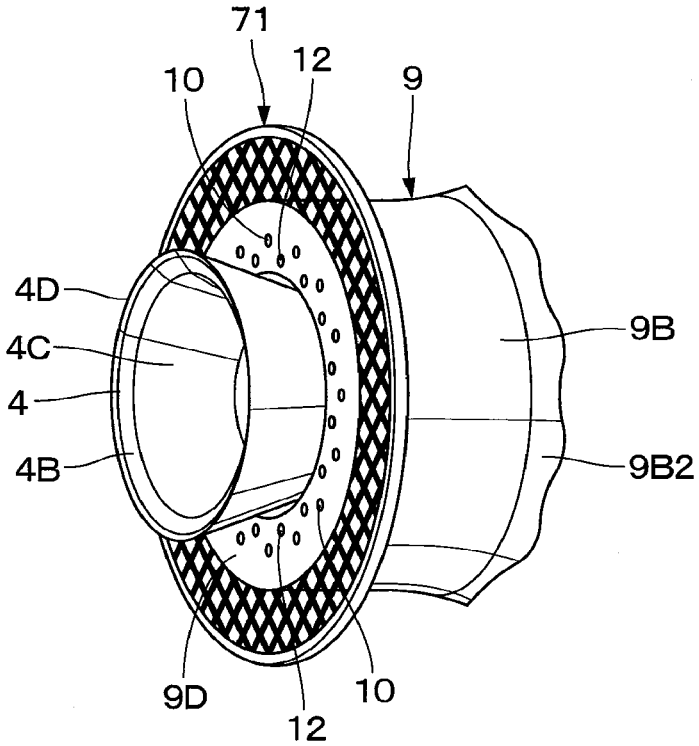
FIG. 9 is an enlarged perspective view showing an essential part of a shield member with a shaping air spurting member and a rotary atomizing head according to a second modification.

In addition, a shield member may be formed as a second modification shown in FIG. 9. That is, a shield member 71 according to the second modification is configured to form a conductive net member in an annular shape, which is connected electrically to the shaping air spurting member 9. Other than the net member, a plate body called a punching plate composed of a metallic plate having many numbers of holes may be used. These configurations can be likewise applied to the other embodiments.

Figure 10:
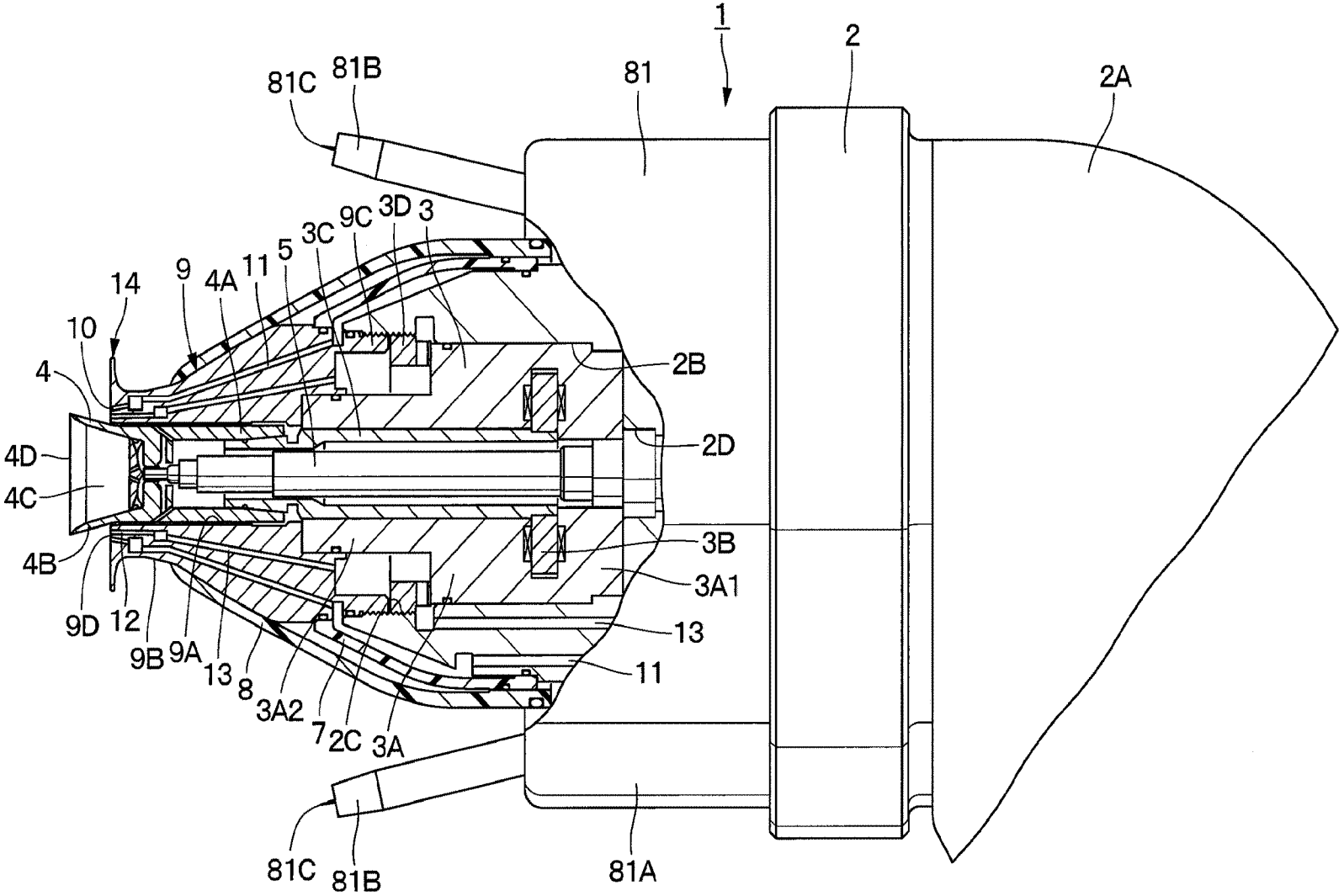
FIG. 10 is a cross sectional view showing a rotary atomizing head type electrostatic coating machine provided with an external electrode member according to a third modification.

On the other hand, in the first embodiment, there is shown a case as an example where the external electrode member 6 includes the annular external electrode support tubular body 6A that is provided on the outer peripheral side of the coating machine support body 2, the plural numbers of electrode mounting holes 6B that are arranged in the annular external electrode support tubular body 6A by equal intervals in the circumferential direction, and the plural numbers of electrodes 6C that are mounted in the plural numbers of electrode mounting holes 6B respectively. However, the present invention is limited thereto, but may be configured as a third modification as shown in FIG. 10, for example. That is, an external electrode member 81 according to the third modification includes an annular external electrode support tubular body 81A that is provided on an outer peripheral side of the coating machine support body 2, a plural numbers of electrode rods 81B that are arranged on the front part of the annular external electrode support tubular body 81A by equal intervals in a circumferential direction to extend forward, and a plural numbers of electrodes 81C that project from front ends of the respective electrode rods 81B. These configurations may be likewise applied to the other embodiments.

Figure 11:
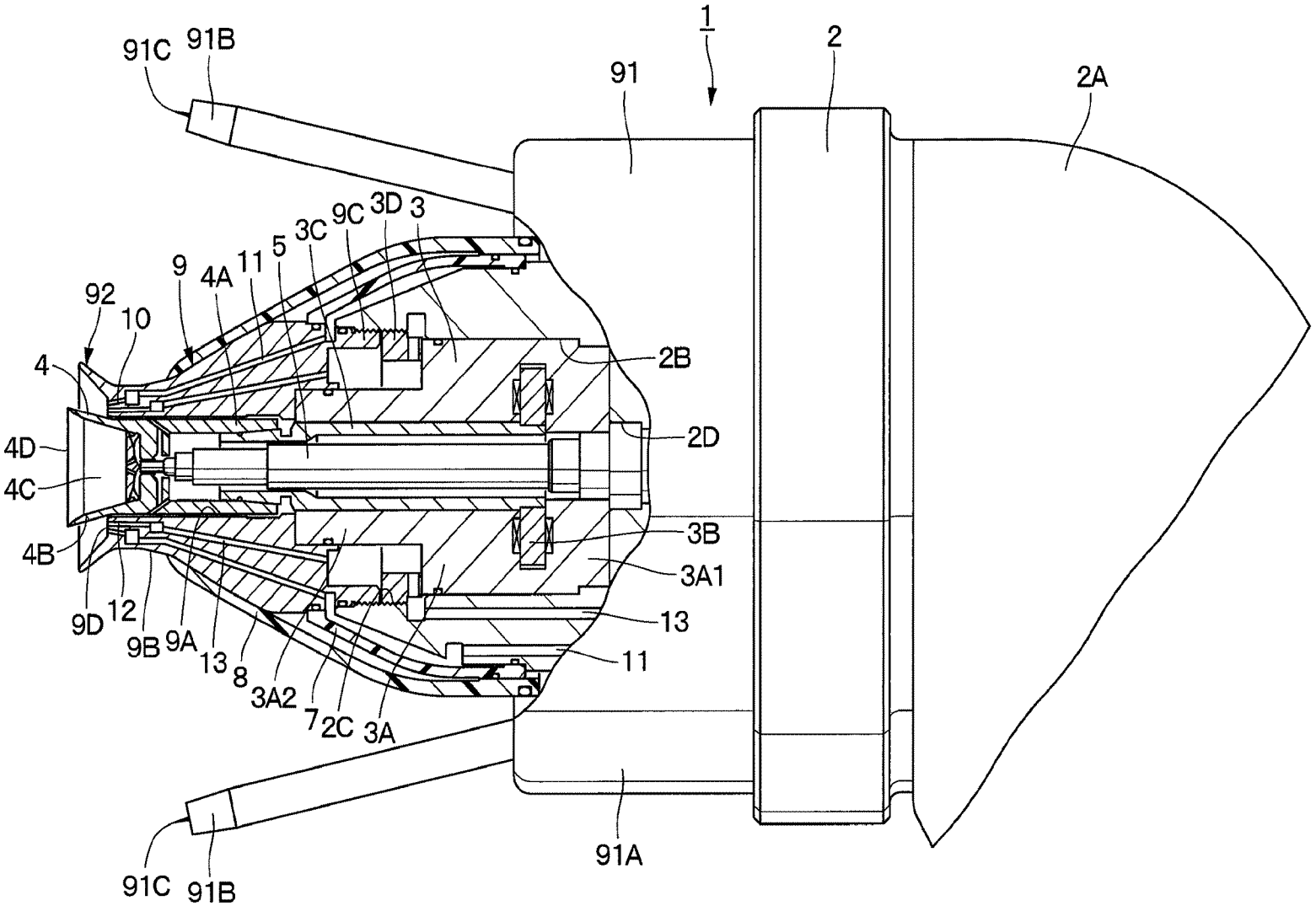
FIG. 11 is a cross sectional view showing a rotary atomizing head type electrostatic coating machine provided with an external electrode member and a shield member according to a fourth modification.

Further, in addition to the third modification, the present invention may be configured as a fourth modification as shown in FIG. 11. In the fourth modification, for efficiently electrifying paint particles to be in the negative polarity, each of electrode rods 91B in an external electrode member 91 is provided such that a front end part thereof is arranged in a position near the front surface section 9D of the shaping air spurting member 9, and electrodes 91C are provided on the respective electrode rods 91B to project therefrom.

Here, as in a case of the fourth modification, in a case where a front end part of each of the electrode rods 91B is arranged to be close to the releasing edge 4D of the rotary atomizing head 4, a shield member 92 composed of a tapered body opening to widen toward the front side is appropriately used, as substantially similar to the shield member 31 according to the second embodiment. That is, the shield member 92 composed of the tapered body is formed in a shape suitable for shielding a straight line connecting a front end (electrode 91C) of the electrode rod 91B arranged forward and the releasing edge 4D of the rotary atomizing head 4. Specifically, the tapered shield member 92 is suitable for covering the circumference of the flare section 4B of the rotary atomizing head 4, and can shield electric flux lines from each of the electrodes 91C while suppressing a radial dimension to be small.

DESCRIPTION OF REFERENCE NUMERALS

1: Rotary atomizing head type electrostatic coating machine
2: Coating machine support body
3: Air motor
3C: Rotational shaft
4: Rotary atomizing head
4D: Releasing edge (Front end)
6, 81, 91: External electrode member
6A, 81A, 91A: External electrode support tubular body
6C, 81C, 91C: Electrode
7: Inner cover member (Cover member)
8: Outer cover member (Cover member)
9: Shaping air spurting member
9B: Outer peripheral surface
9D: Front surface section (Front side section)
10: First air spurting hole (Air spurting hole)
12: Second air spurting hole (Air spurting hole)
14, 31, 41, 51, 61, 71, 92: Shield member
14A: Front surface part
15: Coating object
18, 19, 20, 23, 24: Electric flux line
81B, 91B: Electrode rod
D: Diameter dimension of a releasing edge in a rotary atomizing head
E: Diameter dimension of a shield member
L: Axial distance dimension between a releasing edge of a rotary atomizing head and a shield member

The invention claimed is:

1. An electrostatic coating machine comprising:
an air motor having an electric potential which is maintained at a ground level and that rotates a rotational shaft with compressed air supplied;
a rotary atomizing head that is provided on a front side of said rotational shaft and is composed of a tubular body having an electric potential which is maintained at the ground level to spray paint, which is supplied while being rotated by said air motor, from a releasing edge in a front end;
an external electrode member that is positioned in back of said rotary atomizing head and is provided on an outer peripheral side of said air motor to electrify paint particles sprayed from said releasing edge in said rotary atomizing head to be in a negative potential by applying a negative high-voltage generating corona discharge to a plurality of electrodes; and
a shaping air spurting member that is formed in a tubular shape by using a conductive material and is arranged on an outer peripheral side of said rotary atomizing head in a state where a front end is positioned in an intermediate section of said rotary atomizing head in a length direction, the front end being provided with a plurality of air spurting holes over an entire circumference in a circumferential direction to spurt shaping air toward paint particles sprayed from said rotary atomizing head, wherein
a shield member formed of a conductive material is provided on an outer peripheral side of a front side section of said shaping air spurting member and is formed of an annular body radially extending to shield electric flux lines traveling toward said releasing edge of said rotary atomizing head from each of said electrodes in said external electrode member.

2. The electrostatic coating machine according to claim 1, wherein
said shield member is formed as a flange-shaped member that extends from an outer peripheral side of said shaping air spurting member.

3. The electrostatic coating machine according to claim 1, wherein
said shield member is formed to be integral with said shaping air spurting member and an electric potential of said shield member is maintained at a ground level through said shaping air spurting member.

4. The electrostatic coating machine according to claim 1, wherein
said shield member is provided to be separated from said shaping air spurting member, and is mounted in a state of being connected electrically to an outer peripheral side of said shaping air spurting member.

5. The electrostatic coating machine according to claim 1, comprising:

a coating machine support body that is provided on an outer peripheral side of said air motor to surround said air motor and extend closer to the rearward than said air motor, wherein said external electrode member includes:

an annular external electrode support tubular body that is provided on an outer peripheral side of said coating machine support body and is formed of an insulating plastic material; and said plurality of electrodes that are arranged in a circumferential direction on the front side of said external electrode support tubular body.

6. The electrostatic coating machine according to claim 1, comprising:

a cover member that is provided between said external electrode member and said shaping air spurting member, said cover member being formed in a tubular shape by an insulating material and surrounding said air motor.

7. The electrostatic coating machine according to claim 1, wherein a relation of a diameter dimension E of said shield member to a diameter dimension D of said releasing edge in said rotary atomizing head is $1.4D \leq E \leq 3.0D$.

8. The electrostatic coating machine according to claim 1, wherein an axial distance dimension L between said releasing edge of said rotary atomizing head and a front surface part of said shield member is $1\ mm \leq L \leq 50\ mm$.

* * * * *